US012600532B2

(12) United States Patent
Park

(10) Patent No.: US 12,600,532 B2
(45) Date of Patent: Apr. 14, 2026

(54) CONTAINER FOR PACKING A FOOD

(71) Applicant: DURE., LTD, Icheon-si (KR)

(72) Inventor: Jong Pil Park, Seongnam-si (KR)

(73) Assignee: DURE., LTD, Icheon-si (KR)

( * ) Notice: Subject to any disclaimer, the term of this patent is extended or adjusted under 35 U.S.C. 154(b) by 0 days.

(21) Appl. No.: 18/813,379

(22) Filed: Aug. 23, 2024

(65) Prior Publication Data

US 2025/0066082 A1 Feb. 27, 2025

(30) Foreign Application Priority Data

Aug. 25, 2023 (KR) ..... 10-2023-0111799

(51) Int. Cl.
*B65D 43/06* (2006.01)
*B65D 43/02* (2006.01)
*B65D 55/06* (2006.01)

(52) U.S. Cl.
CPC ..... *B65D 43/065* (2013.01); *B65D 43/0212* (2013.01); *B65D 55/06* (2013.01); *B65D 2543/00194* (2013.01); *B65D 2543/00333* (2013.01); *B65D 2543/00509* (2013.01); *B65D 2543/00537* (2013.01); *B65D 2543/00555* (2013.01); *B65D 2543/0062* (2013.01); *B65D 2543/00703* (2013.01); *B65D 2543/00731* (2013.01); *B65D 2543/00814* (2013.01)

(58) Field of Classification Search
CPC .. B65D 43/065; B65D 43/0212; B65D 55/06; B65D 2543/00194; B65D 2543/00333; B65D 2543/00509; B65D 2543/00537; B65D 2543/00555; B65D 2543/0062; B65D 2543/00703; B65D 2543/00731; B65D 2543/00814
See application file for complete search history.

(56) References Cited

U.S. PATENT DOCUMENTS

| | | | | |
|---|---|---|---|---|
| 6,308,858 | B1 * | 10/2001 | Koefelda | B65D 21/0222 220/608 |
| 8,308,021 | B2 * | 11/2012 | Turvey | B65D 43/0218 220/780 |
| 2010/0108705 | A1 * | 5/2010 | De Jesus | B65D 43/0249 220/789 |
| 2014/0190969 | A1 * | 7/2014 | Huang | B65D 77/2032 220/268 |
| 2018/0194523 | A1 * | 7/2018 | Plummer | B65D 75/5833 |

FOREIGN PATENT DOCUMENTS

| | | | | |
|---|---|---|---|---|
| GB | 2305415 A | * | 4/1997 | B65D 21/0233 |
| KR | 20-2014-0002680 U | | 5/2014 | |
| KR | 102050781 B1 | | 12/2019 | |
| KR | 102200048 B1 | | 1/2021 | |
| KR | 102387561 B1 | | 4/2022 | |

* cited by examiner

*Primary Examiner* — James N Smalley
(74) *Attorney, Agent, or Firm* — Bridgeway IP Law Group, PLLC; Jihun Kim

(57) ABSTRACT

An embodiment relates to a food packaging container including a main body having a first rim portion provided at an upper edge thereof, and a cover having a second rim portion provided at an edge thereof, and a recessed groove formed in a bottom surface of the second rim portion so that the first rim portion is inserted into the recessed groove.

8 Claims, 6 Drawing Sheets

CONTAINER FOR PACKING A FOOD

CROSS-REFERENCE TO RELATED APPLICATIONS

This application claims priority to and the benefit of Korean Patent Application No. 10-2023-0111799 filed in the Korean Intellectual Property Office on Aug. 25, 2023, the entire contents of which are incorporated herein by reference.

TECHNICAL FIELD

The present invention relates to a food packaging container.

BACKGROUND ART

With the recent increase in single-person households and people enjoying quick meals, the delivery food culture has been rapidly developed. Meals are delivered in the state of being accommodated in food packaging containers. The food packaging container is a disposable container typically including a main body having a storage space capable of storing food and drink, and a cover configured to cover the main body. Most of the food packaging containers may be made of plastic materials.

In the food packaging container in the related art, a coupling structure between the main body and the cover is simple, such that the cover coupled to the main body may be easily separated. However, because a separate device capable of stably stacking the main body on the cover is not provided, the main body cannot be stacked on the cover. Even though the cover separated from the main body is coupled to the main body again, whether the main body has been opened cannot be identified. For this reason, it is impossible to verify the quality and safety of the packaged food.

DOCUMENT OF RELATED ART

Patent Document (Patent Document 1) Korean Patent Application Laid-Open No. 20-2014-0002680 (published on May 9, 2014)

SUMMARY OF THE INVENTION

The present invention has been made in an effort to provide a food packaging container, in which a cover may be securely coupled to an upper portion of a main body, the main body may be stably stacked on the cover, and the cover coupled to the upper portion of the main body may be easily separated by cutting an opening protrusion.

In order to achieve the above-mentioned object, the present invention provides a food packaging container including: a main body having a first rim portion provided at an upper edge thereof; and a cover having a second rim portion provided at an edge thereof, and a recessed groove formed in a bottom surface of the second rim portion so that the first rim portion is inserted into the recessed groove.

In addition, the recessed groove may include: a first recessed groove; and a second recessed groove positioned above the first recessed groove and having a larger width than the first recessed groove so that a catching stepped portion is formed on a boundary between the first recessed groove and the second recessed groove.

In addition, the first rim portion may include: an extension portion inserted into the first recessed groove; and a hook portion provided at an end of the extension portion and configured to be caught by the catching stepped portion when inserted into the second recessed groove.

In addition, the cover may have a seating surface provided inside the second rim portion of an upper surface of the cover, and the cover may have at least one protrusion provided at an edge of the seating surface.

In addition, an insertion groove, into which the protrusion is inserted, may be provided in a bottom surface of the main body.

In addition, the protrusions may be provided on four corners of the seating surface and have oblique shapes directed toward a center of the seating surface from the four corners of the seating surface.

In addition, an opening part may be formed on the second rim portion.

In addition, the opening part may include: an opening protrusion protruding upward and configured to be coupled to a pressing protrusion provided on the first rim portion; a connection portion configured to connect at least a part of the opening protrusion to the second rim portion; and a tear line provided at an edge of the opening protrusion, except for the connection portion, and configured to be torn when the opening part is opened, a part of the edge of the opening protrusion may be cut and opened so that the tear line is torn and the pressing protrusion is exposed, and then the exposed pressing protrusion may be pushed downward from above, such that the main body and the cover are separated.

The opening protrusion may have a quadrangular shape.

One surface of the pressing protrusion, which is directed toward the inside of the main body, may be configured as an inclined surface so as to have a width that decreases upward, and the other surface of the pressing protrusion, which is directed toward the outside of the main body, may be configured as a vertical surface.

According to the present invention, the cover may be securely coupled to the upper portion of the main body, which may prevent a leak of food accommodated in the main body.

In addition, according to the present invention, the insertion groove, into which the protrusion of the cover is inserted, is provided in the bottom surface of the main body, such that the main body may be stably stacked on the cover.

In addition, according to the present invention, when a part of the edge of the opening protrusion provided on the cover is cut and opened so that the tear line is torn, the pressing protrusion is exposed, and the exposed pressing protrusion is pushed downward from above, such that the main body and the cover may be easily separated.

In addition, according to the present invention, because the opening protrusion may be cut and cannot be restored to the original state, whether the cover has been opened may be easily identified, which may ensure the reliability related to the stability and quality of food packaged in the food packaging container.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
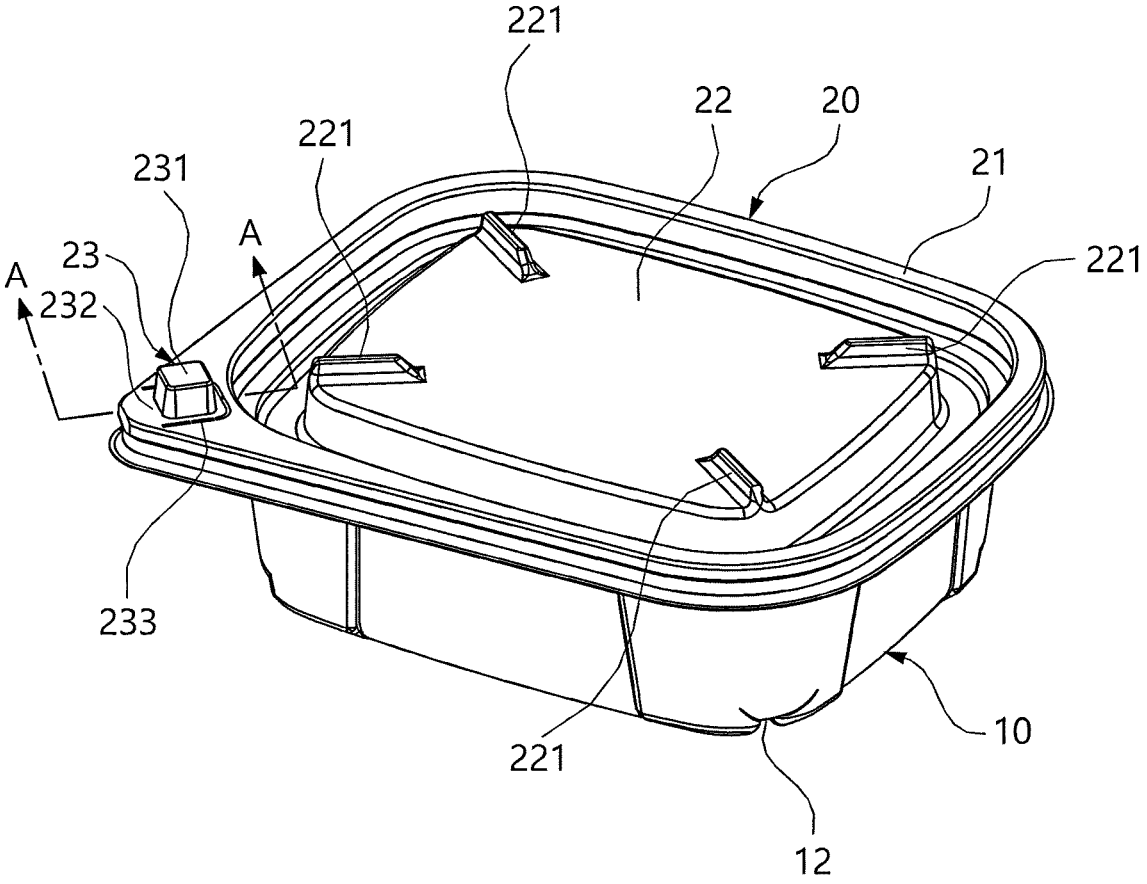
FIG. 1 is a perspective view of a food packaging container according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings. First, in assigning reference numerals to constituent elements of the respective drawings, it should be noted that the same constituent elements will be designated by the same reference numerals, if possible, even though the constituent elements are illustrated in different drawings. In addition, in the description of the present invention, the specific descriptions of publicly known related configurations or functions will be omitted when it is determined that the specific descriptions may obscure the subject matter of the present invention. Further, the exemplary embodiments of the present invention will be described below, but the technical spirit of the present invention is not limited thereto and may of course be modified and variously carried out by those skilled in the art.

Figure 2:
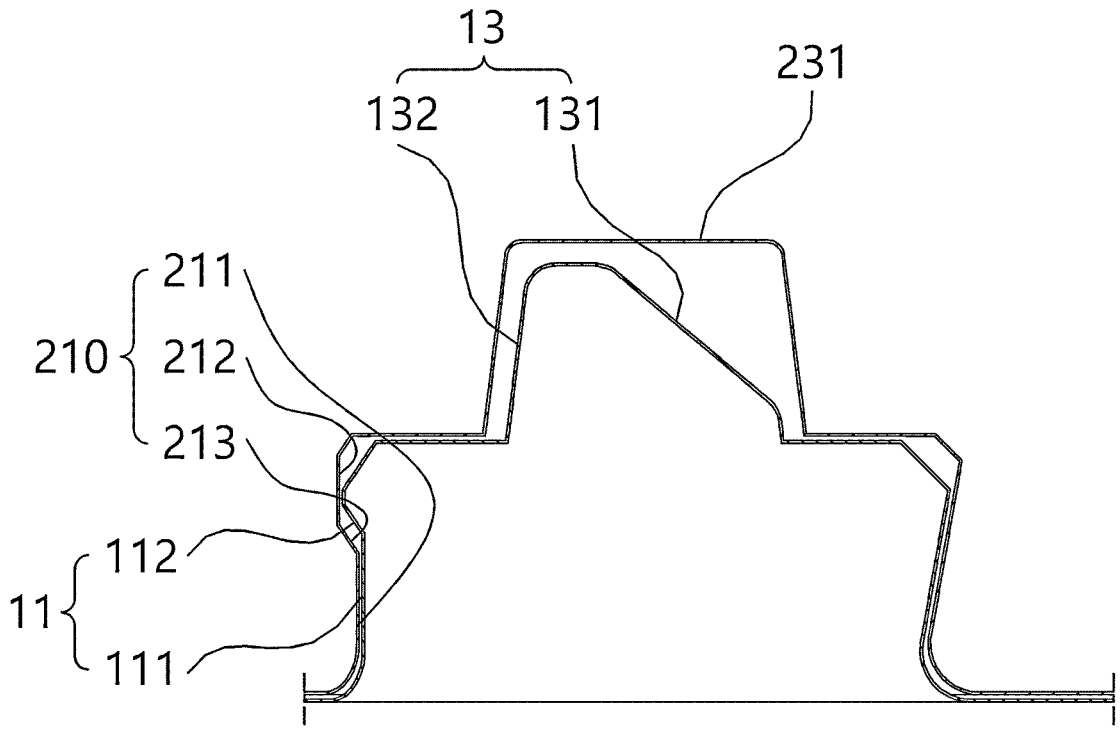
FIG. 2 is a cross-sectional view taken along line A-A in FIG. 1.

FIG. 1 is a perspective view of a food packaging container according to an exemplary embodiment of the present invention, and FIG. 2 is a cross-sectional view taken along line A-A in FIG. 1.

As illustrated in FIGS. 1 and 2, the food packaging container of the present invention includes a main body 10 configured to accommodate various types of food therein, and a cover 20 coupled to an upper portion of the main body 10. For example, the main body 10 and the cover 20 may each have a quadrangular shape.

A first rim portion 11 may be provided at an upper edge of the main body 10. A second rim portion 21 may be provided at an edge of the cover 20.

As illustrated in FIG. 2, a recessed groove 210 may be provided in a bottom surface of the second rim portion 21. The first rim portion 11 may be inserted into the recessed groove 210 when the cover 20 is coupled to the upper portion of the main body 10.

The recessed groove 210 includes a first recessed groove 211 and a second recessed groove 212. The first recessed groove 211 and the second recessed groove 212 may be sequentially configured upward from the bottom surface so that the first recessed groove 211 and the second recessed groove 212 communicate with each other.

The second recessed groove 212 may be positioned above the first recessed groove 211. The second recessed groove 212 may have a larger width than the first recessed groove 211.

Because the second recessed groove 212 has a larger width than the first recessed groove 211, a catching stepped portion 213 may be formed on a boundary between the first recessed groove 211 and the second recessed groove 212.

The first rim portion 11 includes an extension portion 111 and a hook portion 112. The extension portion 111 may be inserted into the first recessed groove 211 when the cover 20 is coupled to the upper portion of the main body 10. When the main body 10 is coupled to the upper portion of the cover 20, the hook portion 112 may be inserted into the second recessed groove 212 and caught by the catching stepped portion 213.

Figure 3:
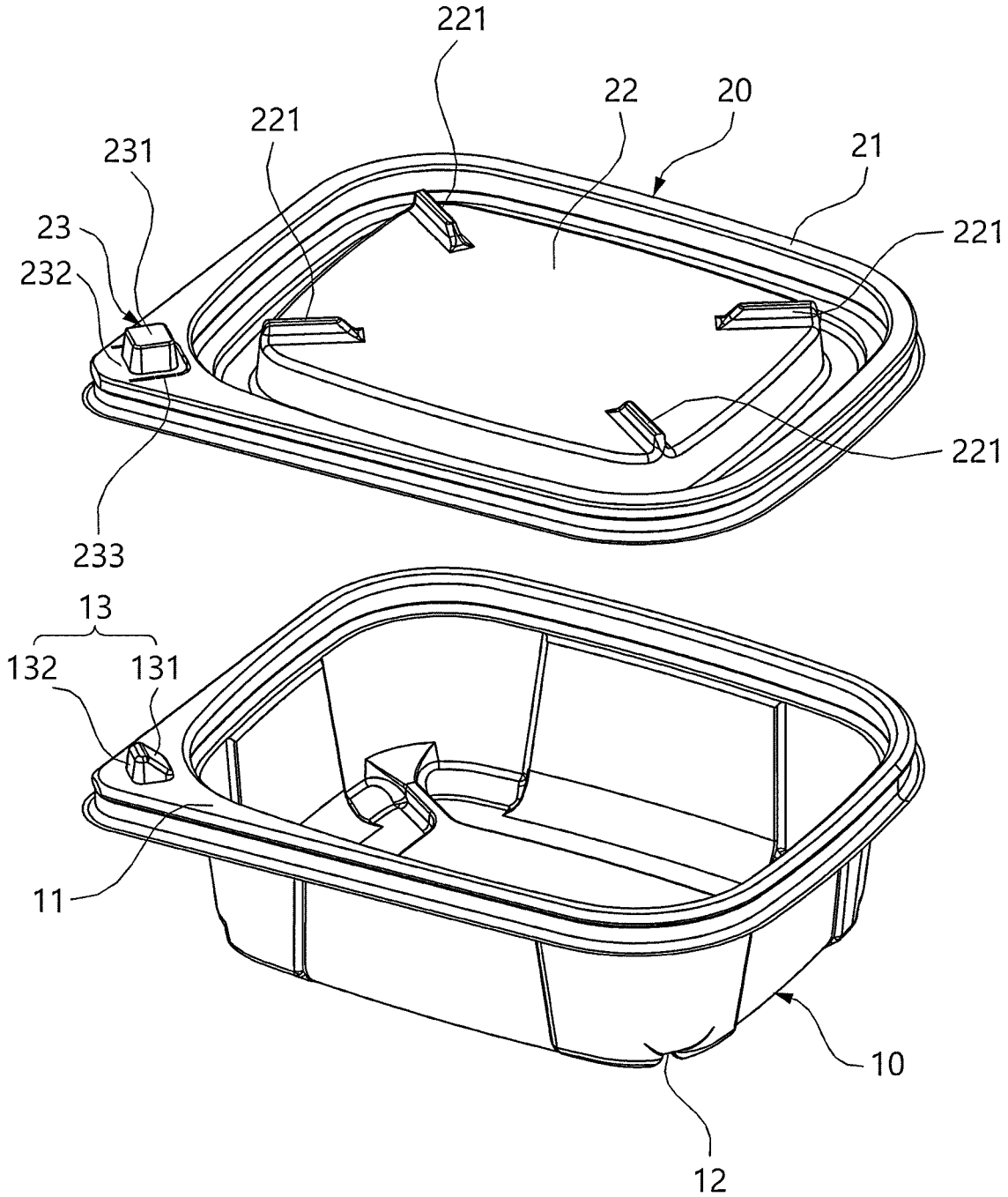
FIG. 3 is an exploded perspective view illustrating a main body and a cover according to the exemplary embodiment of the present invention.
Figure 4:
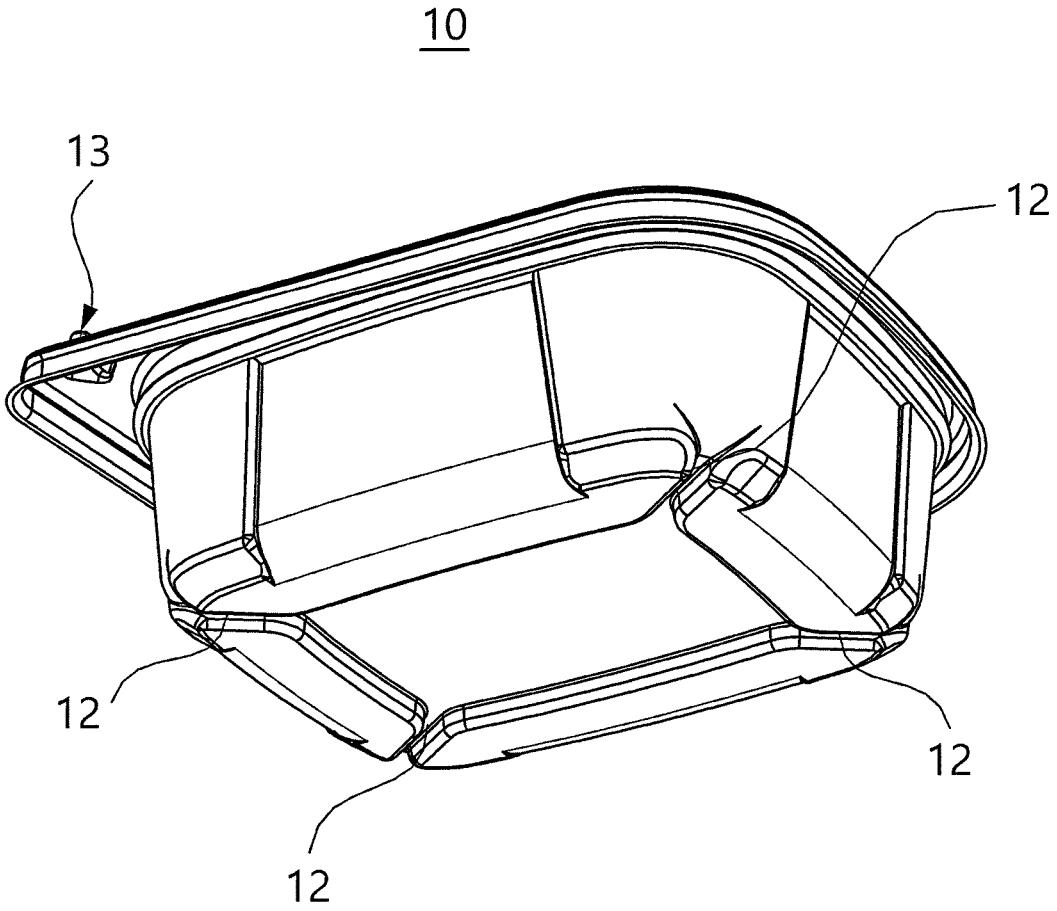
FIG. 4 is a bottom perspective view of the main body according to the exemplary embodiment of the present invention.
Figure 5:
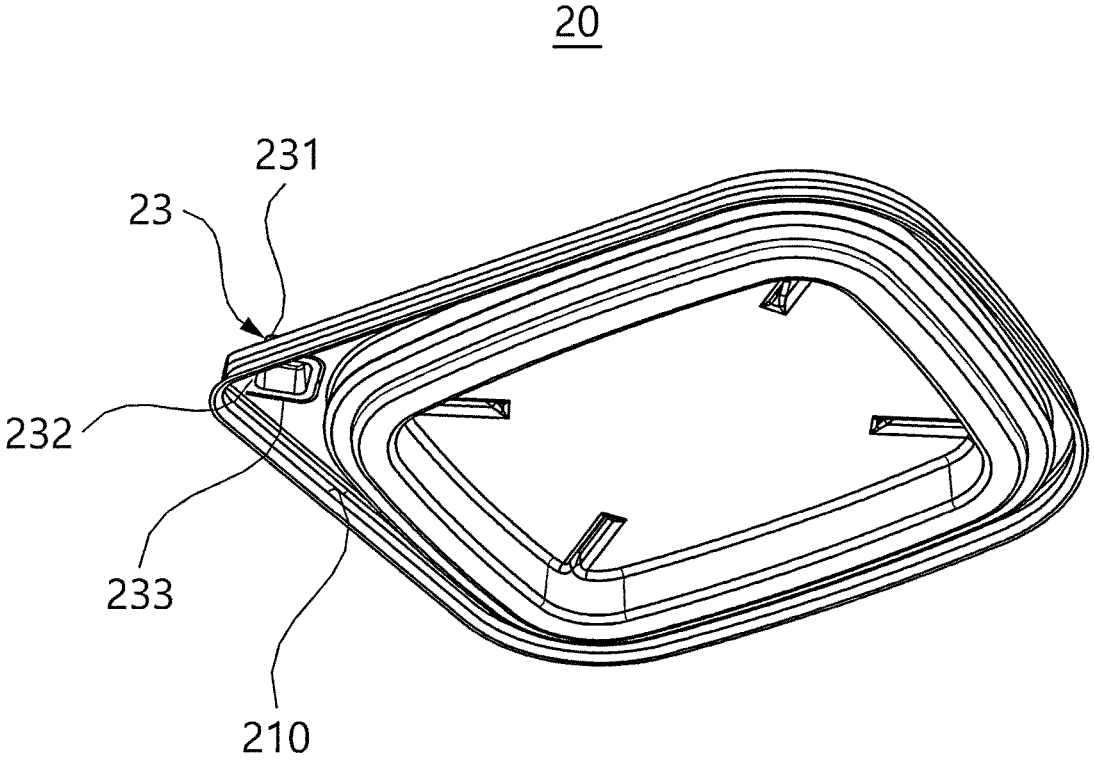
FIG. 5 is a bottom perspective view of the cover according to the exemplary embodiment of the present invention.

FIG. 3 is an exploded perspective view illustrating the main body and the cover according to the exemplary embodiment of the present invention, FIG. 4 is a bottom perspective view of the main body according to the exemplary embodiment of the present invention, and FIG. 5 is a bottom perspective view of the cover according to the exemplary embodiment of the present invention.

As illustrated in FIGS. 3 to 5, a seating surface 22 may be provided on an upper surface of the cover 20. The seating surface 22 may be configured as a flat surface. The seating surface 22 may be provided inside the second rim portion 21. For example, the seating surface 22 may have a quadrangular shape.

Protrusions 221 each having an oblique shape may be provided on four corners of the seating surface 22. The protrusions 221 may be provided on the four corners of the seating surface 22 and directed toward a center of the seating surface 22.

Insertion grooves 12 may be provided in a bottom surface of the main body 10. When the main body 10 is stacked on the cover 20, the protrusion 221 of the cover 20 may be inserted into the insertion groove 12 of the main body 10.

Because the protrusion 221 is formed in an oblique shape, the main body 10 stacked on the cover 20 may be kept stably stacked without being easily withdrawn from the cover 20 even though an external impact is applied.

As illustrated in FIGS. 1, 3, and 5, an opening part 23 may be provided on the second rim portion 21.

The opening part 23 includes an opening protrusion 231, a connection portion 232, and a tear line 233. The opening protrusion 231 may protrude upward. For example, the opening protrusion 231 may have a quadrangular shape.

When the cover 20 is coupled to the upper portion of the main body 10, the opening protrusion 231 may be coupled to a pressing protrusion 13 provided on the first rim portion 11.

At least a part of the opening protrusion 231 may be connected to the second rim portion 21 by the connection portion 232.

The tear line 233 may be provided at an edge of the opening protrusion 231, except for the connection portion 232. When an external force is applied to the opening protrusion 231, the tear line 233 may be torn, and a part of the edge of the opening protrusion 231 may be cut. For example, the tear line 233 may be perforated in a shape similar to a "n" shape.

As a part of the edge of the opening protrusion 231 is cut, the pressing protrusion 13 inserted into the opening protrusion 231 may be exposed.

The pressing protrusion 13 may be configured to have a width that decreases upward. One surface of the pressing protrusion 13, which is directed toward the inside of the main body 10, may be configured as an inclined surface 131. The other surface of the pressing protrusion 13, which is directed toward the outside of the main body 10, may be configured as a vertical surface 132 or a gradual vertical inclined surface.

Figure 6:
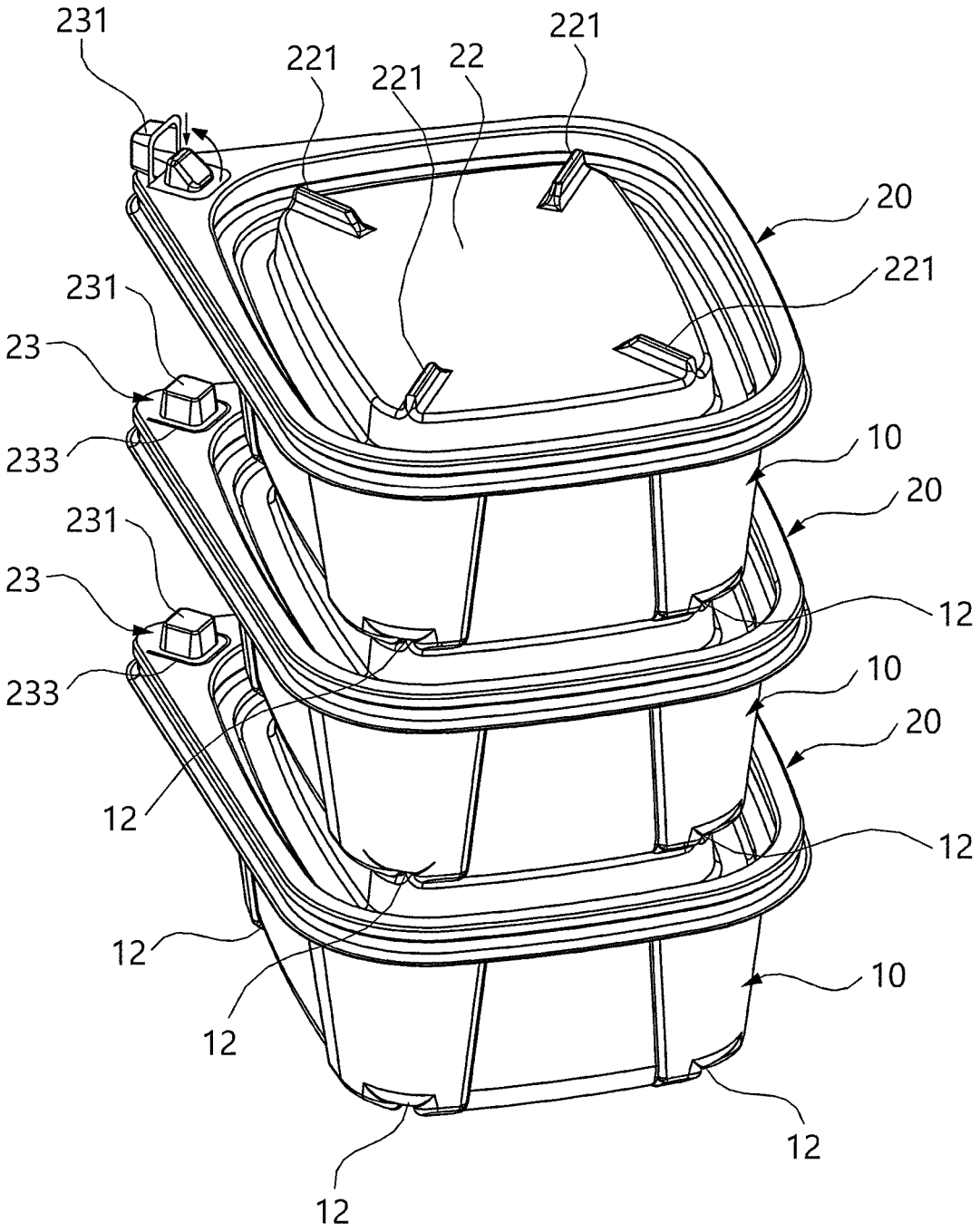
FIG. 6 is a view illustrating a state in which the food packaging containers according to the exemplary embodiment of the present invention are stacked.

FIG. 6 is a view illustrating a state in which the food packaging containers according to the exemplary embodiment of the present invention are stacked.

As illustrated in FIG. 6, because one surface of the pressing protrusion 13 is configured as the inclined surface 131, the opening protrusion 231 may be rotated in a direction from the inclined surface 131 of the pressing protrusion 13 toward the vertical surface 132 without being caught by the pressing protrusion 13 during the process of cutting the opening protrusion 231, such that the opening protrusion 231 may be smoothly cut.

Next, an operation of the present invention will be described.

As illustrated in FIGS. 1 to 3, when the cover 20 is coupled to the upper portion of the main body 10, the first rim portion 11 of the main body 10 may be inserted into the recessed groove 210 provided in the second rim portion 21 of the cover 20, and the main body 10 and the cover 20 are securely coupled, such that the main body 10 may be sealed.

As described above, the first rim portion 11 of the main body 10 is completely inserted into the recessed groove 210 of the cover 20, such that it is not easy to separate the cover 20 from the main body 10.

Specifically, when the cover 20 is coupled to the main body 10, the extension portion 111 may be inserted into the first recessed groove 211, and the hook portion 112 may be inserted into the second depressed portion 212 and caught by the catching stepped portion 213, such that the cover 20 coupled to the upper portion of the main body 10 cannot be easily separated.

As illustrated in FIGS. 5 and 6, when the main body 10 is pushed outward by an external force applied to the opening protrusion 231, the tear line 233 may be torn, and a part of the edge of the opening protrusion 231 may be cut.

Even though a part of the edge of the opening protrusion 231 is cut, a part of the opening protrusion 231 is connected to the cover 20 by the connection portion 232.

When a part of the edge of the opening protrusion 231 provided on the cover 20 is cut and opened so that the tear line 133 is torn, the pressing protrusion 13 is exposed, and the exposed pressing protrusion 13 is pushed downward from above, such that the main body 10 and the cover 20 may be easily separated.

Because the vertically downward force applied to the pressing protrusion 13 is applied to the main body 10, the first rim portion 11 of the main body 10 inserted into the recessed groove 210 of the cover 20 may be easily separated.

The opening protrusion 231 of the cover 20 and the pressing protrusion 13 of the main body 10 need to be essentially provided to separate the main body 10 and the cover 20.

For example, in the absence of the opening protrusion 231, the pressing protrusion 13 cannot be exposed, the pressing protrusion 13 cannot be pushed, and the main body 10 and the cover 20 cannot be separated.

In contrast, according to the present invention, when a part of the edge of the opening protrusion 231 provided on the cover 20 is cut and opened so that the tear line 133 is torn, the pressing protrusion 13 is exposed, and the exposed pressing protrusion 13 is pushed downward from above, such that the main body 10 and the cover 20 may be easily separated.

Meanwhile, when the main body 10 is stacked on the cover 20, the four protrusions 221, which are provided on the four corners of the seating surface 22 of the cover 20, are inserted into the four insertion grooves 12 provided in the bottom surface of the main body 10, such that the main body 10 may be stably stacked on the cover 20.

As described above, according to the present invention, the cover may be securely coupled to the upper portion of the main body, which may prevent a leak of food accommodated in the main body. In addition, according to the present invention, the insertion groove, into which the protrusion of the cover is inserted, is provided in the bottom surface of the main body, such that the main body may be stably stacked on the cover. In addition, according to the present invention, when a part of the edge of the opening protrusion provided on the cover is cut and opened so that the tear line is torn, the pressing protrusion is exposed, and the exposed pressing protrusion is pushed downward from above, such that the main body and the cover may be easily separated. In addition, according to the present invention, because the opening protrusion may be cut and cannot be restored to the original state, whether the cover has been opened may be easily identified, which may ensure the reliability related to the stability and quality of food packaged in the food packaging container.

The above description is simply given for illustratively describing the technical spirit of the present invention, and those skilled in the art to which the present invention pertains will appreciate that various modifications, changes, and substitutions are possible without departing from the essential characteristic of the present invention. Accordingly, the embodiments disclosed in the present invention and the accompanying drawings are intended not to limit but to describe the technical spirit of the present invention, and the scope of the technical spirit of the present invention is not limited by the embodiments and the accompanying drawings. The protective scope of the present invention should be construed based on the following claims, and all the technical spirit in the equivalent scope thereto should be construed as falling within the scope of the present invention.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A food packaging container comprising:

a main body having a first rim portion disposed at a top edge thereof; and a cover having a second rim portion disposed at an edge thereof, and a recessed groove defined in a bottom surface of the second rim portion, the first rim portion being inserted into the recessed groove, wherein an opening part is defined on the second rim portion, wherein the opening part comprises:

an opening protrusion protruding upward and configured to be coupled to a pressing protrusion disposed on the first rim portion;

a connection portion configured to connect at least a part of the opening protrusion to the second rim portion; and a tear line disposed at an edge of the opening protrusion, except for the connection portion, and configured to be torn when the opening part is opened, and wherein a part of the edge of the opening protrusion is cut and opened so that the tear line is torn and the pressing protrusion is exposed, and then the pressing protrusion is pushed downward from above, such that the main body and the cover are separated.

2. The food packaging container of claim 1, wherein the recessed groove comprises:

a first recessed groove; and a second recessed groove disposed above the first recessed groove and having a larger width than a width of the first recessed groove so that a catching stepped portion is defined on a boundary between the first recessed groove and the second recessed groove.

3. The food packaging container of claim 2, wherein the first rim portion comprises:

an extension portion inserted into the first recessed groove; and a hook portion disposed at an end of the extension portion and configured to be caught by the catching stepped portion when inserted into the second recessed groove.

4. The food packaging container of claim 1, wherein the cover has a seating surface disposed inside the second rim portion of a top surface of the cover, and the cover has protrusions disposed at an edge of the seating surface.

5. The food packaging container of claim 4, wherein an insertion groove, into which each of the protrusions is inserted, is disposed in a bottom surface of the main body.

6. The food packaging container of claim 5, wherein the protrusions are disposed on four corners of the seating surface and have oblique shapes directed toward a center of the seating surface from the four corners of the seating surface.

7. The food packaging container of claim 1, wherein the opening protrusion has a quadrangular shape.

8. The food packaging container of claim 7, wherein one surface of the pressing protrusion, which is directed toward inside of the main body, is configured as an inclined surface and to have a width that decreases upward, and another surface of the pressing protrusion, which is directed toward outside of the main body, is configured as a vertical surface.

* * * * *